United States Patent [19]

Alley et al.

[11] Patent Number: 4,764,744

[45] Date of Patent: Aug. 16, 1988

[54] OVERLOAD RELAY HAVING ADJUSTABLY GAPPED CURRENT TRANSFORMERS

[75] Inventors: Robert P. Alley, Clifton Park; Fred G. Turnbull, Scotia, both of N.Y.

[73] Assignee: General Electric Company, Schenectady, N.Y.

[21] Appl. No.: 134,267

[22] Filed: Dec. 17, 1987

[51] Int. Cl.[4] ..... H01F 21/06

[52] U.S. Cl. ..... 336/131; 336/134; 336/175

[58] Field of Search ..... 361/28, 31, 44, 42, 361/47; 336/130, 131, 10, 132, 133, 134, 173, 174, 175, 117, 118, 119; 334/77

[56] References Cited

U.S. PATENT DOCUMENTS

| | | | |
|---|---|---|---|
| 2,523,117 | 9/1950 | Jennings | 336/134 X |
| 3,602,771 | 8/1971 | Walstad et al. | 317/13 R |
| 3,683,237 | 8/1972 | Walstad et al. | 317/13 R |
| 3,761,853 | 9/1973 | Schutz et al. | 336/131 X |
| 4,007,401 | 2/1977 | Kimmel et al. | 317/36 TD |
| 4,115,829 | 9/1978 | Howell | 361/42 |
| 4,156,262 | 5/1979 | Eller et al. | 361/28 |
| 4,443,828 | 4/1984 | Legrand et al. | 361/93 |
| 4,454,557 | 6/1984 | Hurley | 361/93 |

*Primary Examiner*—Thomas J. Kozma

*Attorney, Agent, or Firm*—Marvin Snyder; James C. Davis, Jr.

[57] ABSTRACT

A static trip overload relay includes a plurality of phase current sensing transformers having two-piece cores. One core piece of each transformer core is positionally mounted by the relay housing, while the other piece is positionally mounted by a carrying case movably mounted within the housing. By varying the case position within the housing, the air gaps between the two core pieces of each transformer core are correspondingly and concurrently varied pursuant to calibrating the relay to operate at any one of a range of circuit current ratings.

12 Claims, 2 Drawing Sheets

OVERLOAD RELAY HAVING ADJUSTABLY GAPPED CURRENT TRANSFORMERS

BACKGROUND OF THE INVENTION

This invention relates to current overload circuit protective devices and more particularly to overload relays utilizing electronic or so-called "static" trip units.

In the past, overload relays, such as utilized to protect electric motors against excessive current, have been of the thermal type wherein a bimetal actuator is heated directly or indirectly as a function of the motor current and operates to effect interruption of the motor circuit under overload conditions. More recently, overload relays have been designed to utilize electronic circuitry responsive to signals derived from the secondary windings of current transformers whose primary windings carry the motor phase currents. The electronic circuitry processes these signals on a current-time integral basis to determine when a current overload condition is sufficiently persistent to require interruption of the motor circuit. This static trip circuit protective approach has become quite popular because of its inherent versatility. That is, the electronic circuitry can be readily designed to recognize not only overload conditions, but also high fault current conditions calling for circuit interruption without delay and hazardous ground fault conditions. Moreover, the electronic circuitry can be readily implemented to provide for convenient calibration to a wide range of motor circuits of different current ratings and trip-time adjustability within a selected current rating to establish a highly repeatable trip-time curve precisely tailored to the particular motor to be protected from overcurrents ranging from light overload to heavy short circuit proportions. Thus, such static trip units may be manufactured in a standard design conducive to compact packaging as a modular unit adaptable to a wide range of circuit interrupter current ratings or motor frame sizes. Recently, it has been proposed to adapt such static trip unit to directly cause a motor starter to interrupt a motor circuit in the event of an overload condition, rather than to operate separate overload relay circuit interrupting contacts.

In adapting a standard static trip unit design to a particular motor circuit application, the trip unit must be calibrated to the current rating of the motor involved. Current calibration adjustability in static trip units is conventionally performed using either of two basic approaches (1) varying the tap settings on the current transform secondary windings, or (2) varying the value of the load resistance(s) across which signal voltages are developed in the input circuit section of the static trip unit. The latter and more popular approach typically involves utilizing rheostats, tap changing voltage divider switches, or rating plugs equipped with resistors of selected values which are plugged into the trip unit input circuit.

All of these prior art approaches to calibration adjustment involve closing of electrical contacts, the integrity of which can become degraded over time when subjected to the hostile environments often encountered in industrial applications. That is, the electrical contacts can and do become fouled with dirt, or loosen when subjected to repeated vibration or shock. This results in failure to hold calibration and thus proper overload protection is jeopardized. In addition, this degradation of electrical contacts can give rise to electrical noise which may cause trip unit malfunctions.

It is accordingly an object of the present invention to provide an improved static trip circuit protective device.

A further object is to provide a circuit protective device in the form of an overload relay which is readily adjustable over a range of calibration settings.

Another object is to provide an overload relay which is capable of reliably maintaining a calibration setting over a long operating life.

A still further object is to provide an overload relay which does not rely on continued integrity of electrical contacts in preserving its calibration setting.

An additional object is to provide a rugged overload relay which is efficient in construction, compact in size, and reliable over a long operating life, even in hostile environments.

Other objects of the invention will in part be obvious and in part appear hereinafter.

SUMMARY OF THE INVENTION

In accordance with the present invention, a polyphase static overcurrent relay comprises a plurality of current sensing transformers, each including a two-piece core having a window through which a different one of the phase conductors of the protected circuit extends as a single-turn primary winding. The two core pieces of each current sensing transformer core provide a closed loop magnetic flux circuit including a pair of air gaps at the junctures thereof. A separate secondary winding is disposed about one of the core pieces of each core for developing a voltage signal proportional to the rate of change of primary current. Corresponding core pieces of the plural cores are commonly mounted on separate, relatively movable structures which, while undergoing adjustment to their relative positions, concurrently vary the air gap widths of the cores uniformly to provide capability for establishing any selected one of a range of overload relay calibration settings.

The invention accordingly comprises the features of construction, combination of elements and arrangement of parts, all of which will be exemplified in the following detailed description, and the scope of the invention will be indicated in the claims.

For a better understanding of the nature and objects of the invention, reference may be made to the following detailed description taken in connection with the drawings, in which.

Corresponding reference numerals refer to like parts throughout the several views of the drawings.

DETAILED DESCRIPTION OF THE PREFERRED EMBODIMENT

Figure 1:
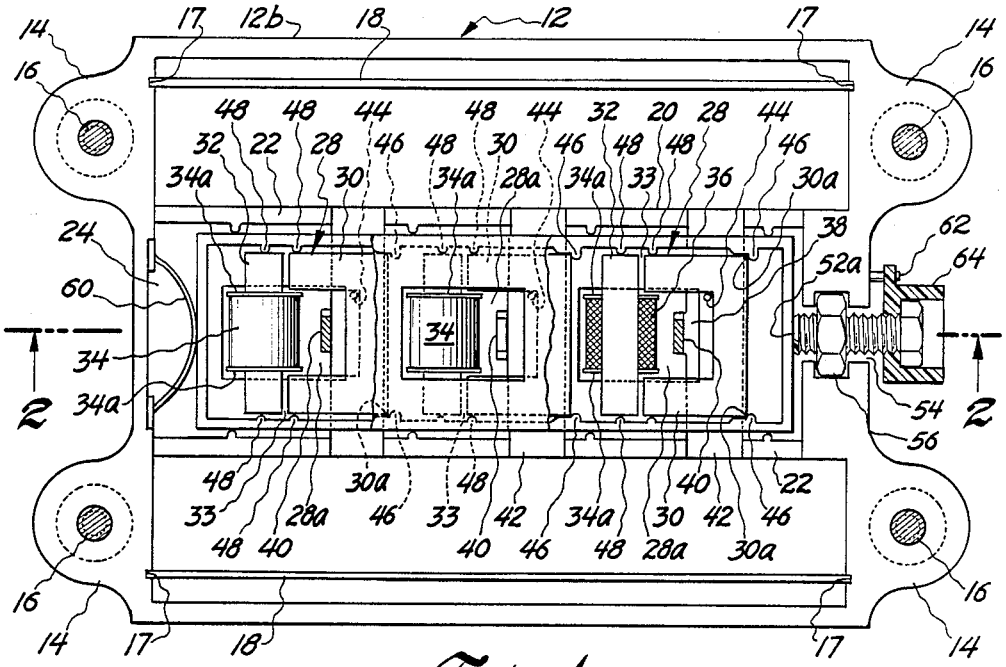
FIG. 1 is a plan view of one-half of a split housing for an overload relay constructed in accordance with the present invention.
Figure 2:
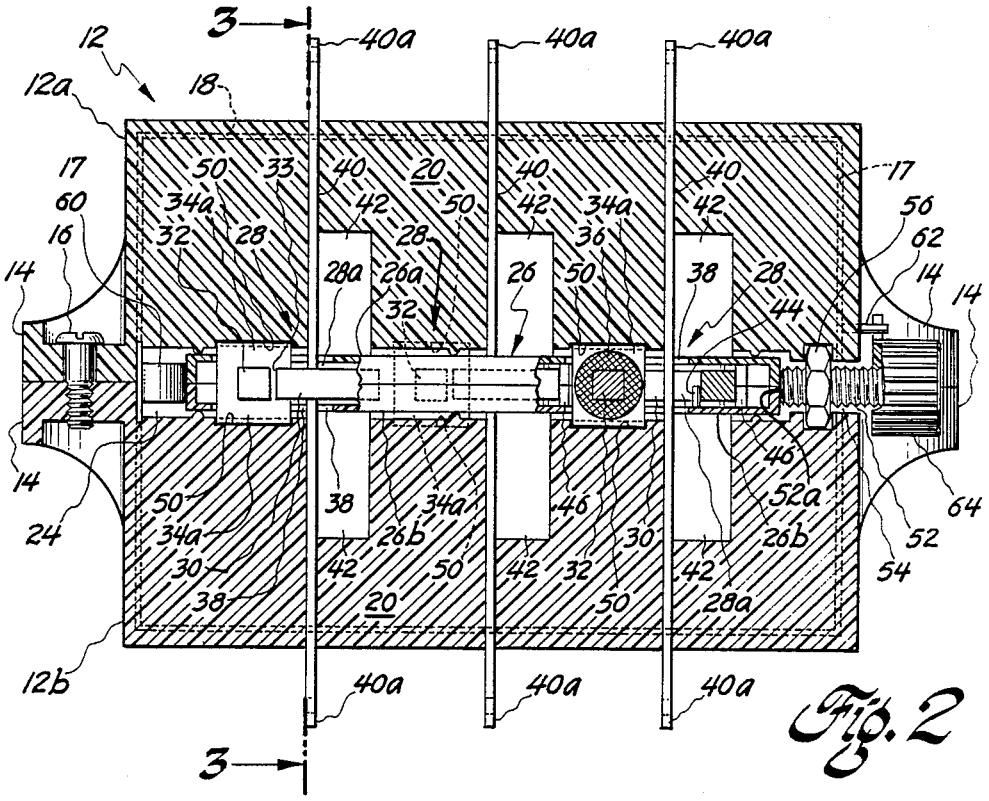
FIG. 2 is a sectional view taken along line 2—2 of FIG. 1 and illustrates the housing halves in assembled relation.
Figure 3:
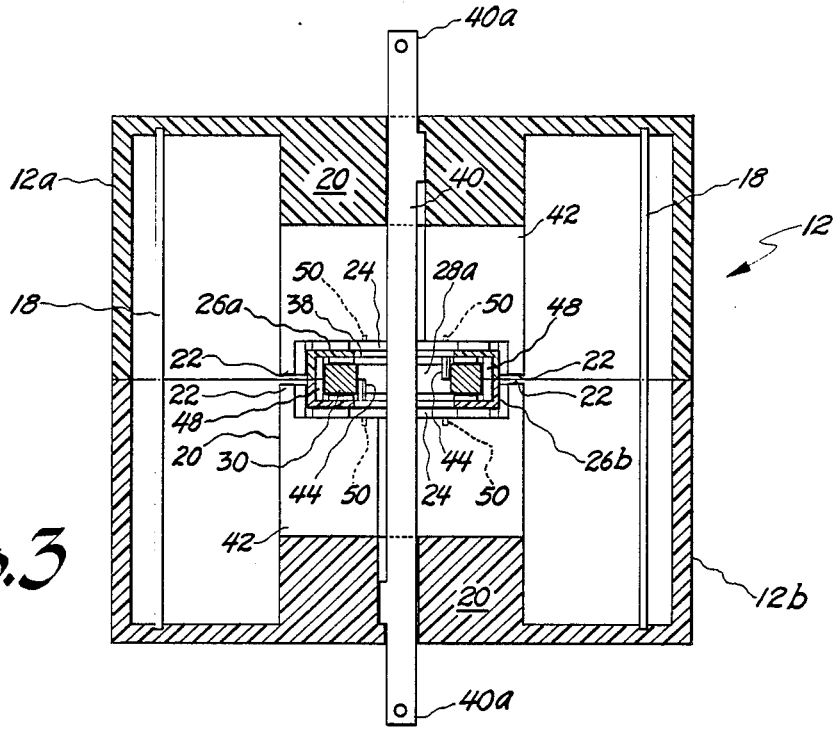
FIG. 3 is a sectional view taken along line 3—3 of FIG. 2.

The overload relay of the present invention, generally indicated at 10, includes a housing 12 consisting of two identical halves 12*a* and 12*b*, as seen in FIG. 2, formed of a suitable molded plastic material. The housing halves are provided with mating ears 14 fashioned to accept threaded fasteners 16 for uniting to form housing 12. As seen in FIG. 1, the housing is provided with pairs of opposed grooves 17 for slidingly receiving and supporting the marginal edges of a pair of printed circuit boards 18 on which are mounted solid state circuit components (not shown) in static trip circuit interconnection. Molded in each housing half is a platform 20 whose raised surfaces are recessed, as indicated at 22. With the housing halves united, these recesses define an elongated, rectangular chamber 24 (FIGS. 2 and 3) in which a current sensing transformer carrying case 26 is slidingly accommodated.

Figure 4:
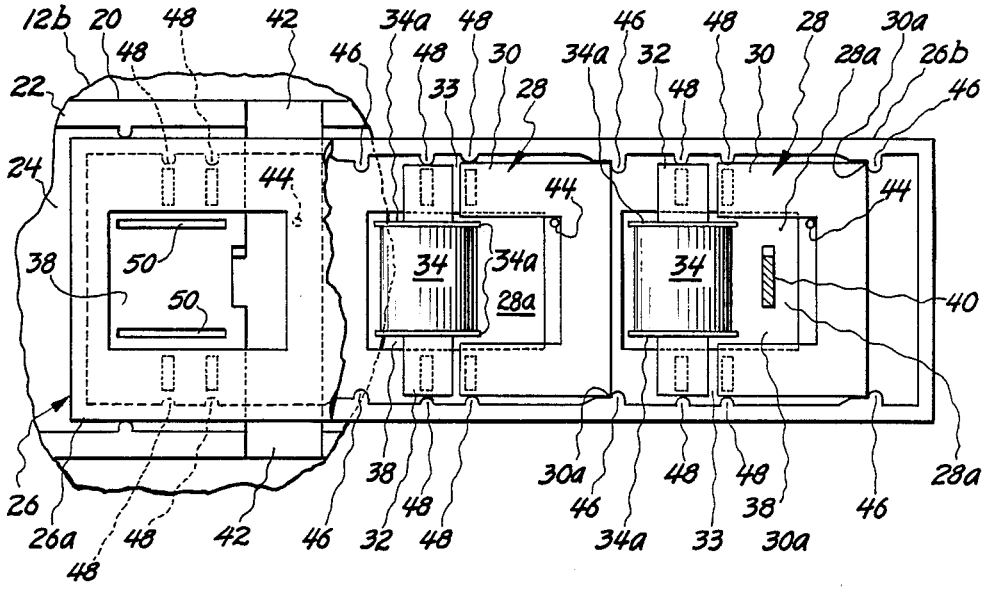
FIG. 4 is a partially cut away plan view of one-half of a split current sensing transformer carrying case accommodated within the housing seen in FIGS. 1-3.

Case 26, molded of plastic in two identical halves **26*a* and 26*b*, one half 26*a* seen in plan view in FIGS. 1 and 4, accommodates three current sensing transformers, generally indicated at 28 and each including a two-piece ferrite core consisting of a C-shaped core piece 30 and an I-shaped core piece 32 bridging the arms of the C-shaped core piece to provide a closed loop magnetic flux circuit. This magnetic circuit includes two air gaps 33 at the junctures between the two core pieces. A separate bobbin 34, embracing the I-core piece 32 of each current sensing transformer, is wound with a multi-turn secondary winding 36, whose terminations (not shown) are wired into the printed circuit boards 18. As seen in FIG. 4, which is a view wherein the left-hand bobbin and I-Core piece are removed to show the detail of the lower half of the upper portion of platform 20 and bobbin flange receiving slots 50, the case halves are apertured, as indicated by aperture 38 in case half 26*a* (which is the lower case half in FIG. 4) to provide clearance for these bobbins as assembled on the I-core pieces. Extending through each current transformer core window 28*a* and case aperture 38 is a busbar 40 of rectangular cross section. These busbars pass through aligned passages 42 (FIG. 3) formed in the split housing platforms 20 to terminations 40*a* accessible at opposed sides of housing 12** for serial electrical connection into each of the line conductors (not shown) of the three-phase motor circuit to be protected.

As best seen in FIG. 4, each of case halves **26*a* and 26*b* is formed with three upstanding locator pins 44 which, in combination with three pairs of opposed locator ribs 46 outstanding from the split case interior sidewalls, serve to establish and maintain the positions of the C-core pieces within case 26 when its halves are mated and held so by suitable clips (not shown). It is seen that pins 44 engage the C-core pieces at corresponding corners of the core windows 28*a* to position their outside corners 30*a* against the pairs of opposed ribs 46. The C-core pieces 30 are thus captured by case 26 at fixed relative positions therein. Opposed alignment ribs 48** outstanding from the case half sidewalls additionally serve to orient the C-core pieces in their respective fixed positions.

The I-core pieces 32, while accommodated in case 26, are, on the other hand, allowed a limited degree of movement relative to the C-core pieces. From FIG. 4 it can be seen that there is ample clearance between an I-core piece 32 and the adjacent pair of opposed locator ribs 46, while the case apertures 38 are sufficiently elongated for adequate clearance with bobbins 34 to accommodate this relative movement which is guided by additional, opposed aligning ribs 48. To mount the I-core pieces 32, the raised surface of the platform 20 in each housing half is formed with precisely located pairs of slots 50, seen in FIGS. 2 and 3, in which the end flanges **34*a* of bobbin 34 are lodged. Each one of end flanges 34*a* is of rectangular or square configuration, viewed along the bobbin longitudinal axis, so as to fit securely within its mating pair of slots 50. When the housing halves are united, the bobbin flanges are captured in opposed pairs of slots 50 to fix the bobbin positions, as well as the I-core piece 32** positions, with respect to the housing.

To commonly vary the positions of the I-core pieces relative to their associated C-core pieces and thus uniformly adjust the width of the air gaps 33, it remains to simply change the position of case 26 within housing 12. To this end, an adjusting screw 52 is inserted through a hole 54 provided in the housing endwall at the housing splitline and threaded through a nut 56 captured against rotation in opposed recesses formed in the platform surfaces, to bring its end **52*a* to bear against one end of case 26. A spring 60 stationed adjacent the opposite housing endwall urges the case into engagement with the adjusting screw tip. The screw is moved by rotating thumbscrew 64, the degree of rotation thereof being limited by engagement with a stop 62. From FIG. 1 it is seen that as screw 52 is backed out of housing 12, spring 60 moves case 26 to the right and also the C-core pieces 30 concurrently, thus uniformly increasing the air gaps between them and the associated, fixedly positioned I-core pieces 32**.

As is well understood in the art, varying the width of the air gaps 33 varies the magnitude of magnetic flux in the current sensing transformer cores and thus the signal voltage developed in the secondary windings 36 for a given level of primary phase current. Consequently, by increasing these air gaps, higher levels of phase current are required to develop a given signal voltage level which the overload relay electronic circuitry will recognize as signifying an overload condition. Thus, by virtue of the present invention, the air gaps 33 may be adjustably set to calibrate the overload relay 10 to any number of different motor circuit current ratings. In fact, it has been determined that by varying each air gap equally through a range of widths from 10 mils to 150 mils, a calibration adjustability range in excess of 3:1 can be readily achieved utilizing the teachings of the present invention. Since the calibration setting does not rely on the continued integrity of electrical contacts, it will remain fixed in the face of hostile industrial environments. It will be appreciated that, during final factory testing, the air gaps 33 are equally adjusted to a standard calibration setting, and trim resistors of predetermined resistance values are hardwired into the input section of the relay circuitry in order to achieve a specified signal voltage. Subsequent field adjustment to a different current rating is then made by turning screw 52 in accordance with indicia which may be applied to the housing endwall.

It will be understood that the shapes of the two core pieces 30 and 32 of each transformer core may be varied without departing from the scope of the present invention. Moreover, while in the illustrated embodiment the air gaps are varied by movement of only one of the core pieces, it will be appreciated that the same result can be achieved by coordinated movements of either or both core pieces relative to each other. While the disclosed embodiment is structured for application to a three-phase circuit, it will be appreciated that the present invention is applicable to any polyphase circuit.

While the present invention has been described in its application to overload relays for motor circuits, it will be appreciated that the teachings thereof may be applied with equal advantage to other types of circuit protective devices, such as circuit breakers, for a wide variety of load circuit applications.

From the foregoing description, it is seen that the objects set forth above, including those made apparent therein, are efficiently attained, and, since certain changes may be made in the disclosed embodiment without departure from the scope of the invention, it is intended that all matter contained in the above description and shown in the accompanying drawing shall be interpreted as illustrative and not in a limiting sense.

Having described the invention, what is claimed as new and desired to secure by Letters Patent is:

1. A circuit protective device comprising,

A. a plurality of current sensing transformer cores, each said core including first and second core pieces disposed in a closed loop magnetic circuit relation about a core window and including at least one air gap;

B. first means commonly mounting said first core pieces in fixed positional relation to each other;

C. second means commonly mounting said second core pieces in fixed positional relation to each other;

D. a separate, respective secondary winding wound about each said core, respectively;

E. a separate, respective busbar extending through said core window of each said core, respectively; and F. adjusting means for adjusting the relative positions of said first and second means to concurrently, uniformly vary the widths of said air gaps in said magnetic loop circuits of said cores.

2. The circuit protective device defined in claim 1 wherein said adjusting means adjusts the position of said second means with respect to said first means.

3. The circuit protective device defined in claim 2 wherein said first means comprises a housing, and said second means comprises a case movably mounted within said housing.

4. The circuit protective device defined in claim 3 wherein said busbars are supported by said housing.

5. The circuit protective device defined in claim 4 wherein each said magnetic circuit includes two air gaps.

6. The circuit protective device defined in claim 5 wherein said two air gaps in each said magnetic circuit are of equal width and are correspondingly variable in width in accordance with the setting of said adjusting means.

7. The circuit protective device defined in claim 6, wherein all of said air gaps in said magnetic circuits are of substantially equal width and are correspondingly variable in width in accordance with the setting of said adjusting means.

8. The circuit protective device defined in claim 7 wherein the second core piece of each said core is fixedly positioned within said case, and the first core piece of each said core is movably positioned within said case in respective, variable air-gapped relation with said second core pieces.

9. The circuit protective device defined in claim 8 wherein said the first core piece of each said core is accessible for mounting by said housing through apertures in said case, said apertures further accommodating the extensions of said busbars through said core windows.

10. The circuit protective device defined in claim 9 wherein said adjusting means includes a screw adjustably advanced through a wall of said housing into engagement with one end of said case and a spring acting between an opposite end of said case and said housing to bias said case into engagement with said screw.

11. The circuit protective device defined in claim 9 wherein each said secondary winding is wound, respectively, on a separate bobbin, respectively, disposed in embracing relation with a separate one of said first core pieces, respectively, said bobbins protruding through said case apertures into positioning engagement with said housing.

12. The circuit protective device defined in claim 8 which further includes at least one printed circuit board mounted by, and within, said housing in proximate relation to said case.

* * * * *